US006942516B2

(12) United States Patent
Shimoyama et al.

(10) Patent No.: US 6,942,516 B2
(45) Date of Patent: Sep. 13, 2005

(54) CONNECTOR AND MATING CONNECTOR AND COMBINATION THEREOF

(75) Inventors: Toshio Shimoyama, Tokyo (JP); Toshio Okamura, Tokyo (JP)

(73) Assignee: Japan Aviation Electronics Industry Limited, Tokyo (JP)

( * ) Notice: Subject to any disclaimer, the term of this patent is extended or adjusted under 35 U.S.C. 154(b) by 0 days.

(21) Appl. No.: 10/739,312

(22) Filed: Dec. 19, 2003

(65) Prior Publication Data

US 2004/0132329 A1 Jul. 8, 2004

(30) Foreign Application Priority Data

Dec. 24, 2002 (JP) ..... 2002/372207

(51) Int. Cl.[7] ..... H01R 13/627
(52) U.S. Cl. ..... 439/352
(58) Field of Search ..... 439/352, 349, 439/347, 585, 848, 675, 322; 285/316, 319

(56) References Cited

U.S. PATENT DOCUMENTS

| | | | | |
|---|---|---|---|---|
| 3,680,033 A | | 7/1972 | Kawai | |
| 3,745,514 A | * | 7/1973 | Brishka | 439/848 |
| 4,017,139 A | * | 4/1977 | Nelson | 439/352 |
| 4,296,992 A | | 10/1981 | Gallagher | |
| 4,516,821 A | * | 5/1985 | Nieman | 439/347 |
| 4,545,633 A | | 10/1985 | McGeary | |
| RE32,864 E | * | 2/1989 | Ezure | 439/152 |
| 4,941,846 A | * | 7/1990 | Guimond et al. | 439/578 |
| 4,966,398 A | * | 10/1990 | Peterson | 285/319 |
| 5,074,809 A | * | 12/1991 | Rousseau | 439/675 |
| 5,147,221 A | * | 9/1992 | Cull et al. | 439/585 |
| 5,176,533 A | * | 1/1993 | Sakurai et al. | 439/352 |
| 5,439,386 A | * | 8/1995 | Ellis et al. | 439/322 |
| 6,179,641 B1 | * | 1/2001 | Kaneko | 439/349 |
| 6,454,463 B1 | | 9/2002 | Halbach et al. | |
| 6,715,801 B2 | * | 4/2004 | Zhadanov | 285/316 |

FOREIGN PATENT DOCUMENTS

JP 1032042 3/1998

OTHER PUBLICATIONS

European Search Report, dated Apr. 27, 2004.

* cited by examiner

*Primary Examiner*—Alexander Gilman
(74) *Attorney, Agent, or Firm*—Baker Botts L.L.P.

(57) ABSTRACT

A plug connector comprises a fitting portion to be fitted with another fitting portion of a receptacle connector. In an outer peripheral surface of the fitting portion, an engagement depression is formed. The engagement depression is depressed in a radial direction of the plug connector. A coupling member surrounds the outer peripheral surface of the fitting portion with a predetermined gap kept therebetween. The coupling member is pressed forwards in an axial direction of the plug connector by a coil spring. The receptacle connector further comprises a spring portion, on the free end of which an engagement projection is provided. The engagement projection projects inwardly in the radial direction. The fitting portion of the receptacle connector has a thickness which is substantially equal to the predetermined gap provided for the plug connector. When the engagement projection is accommodated in the engagement depression, the fitting portion of the receptacle connector is fitly received within the predetermined gap between the fitting portion and the coupling member so that the coupling of the plug and the receptacle connectors is locked.

10 Claims, 17 Drawing Sheets

CONNECTOR AND MATING CONNECTOR AND COMBINATION THEREOF

This application claims priority to prior Japanese application JP 2002-372207, the disclosure of which is incorporated herein by reference.

BACKGROUND OF THE INVENTION

This invention relates to a combination of an electrical connector (which will simply be referred to as "connector") and a mating connector, which are mated with each other and can be locked together.

JP-A H10-32042 discloses a connector and a mating connector, which are lockable together under the mating state thereof. The connector is a coaxial cable connector and has inner and outer conductors. The outer conductor has a first spring portion, which extends in an axial direction of the connector. A free end of the first spring portion is provided with a first inwardly-projecting portion. Upon the coupling of the connector and the mating connector, the first inwardly-projecting portion is engaged with a recess portion which is formed in an outer surface of the mating connector.

To secure the engagement and to fix two connectors in a locked state, the connector further comprises a movable member and a coupling nut. The movable member comprises a second spring portion, which extends in the axial direction. A free end of the second spring portion is provided with a second inwardly-projecting portion. The movable member is movable along the axial direction so that the second inwardly-projecting portion can project forwards beyond the first inwardly-projecting portion in the axial direction. The coupling nut is also movable along the axial direction. Specifically, the coupling nut can move backwards relative to the movable member.

Locking and unlocking operations are simple. When the connector is pressed against the mating connector to couple together, the locked state is established. Under the locked state, the first inwardly-projecting portion is engaged with the recess portion of the mating connector, and the second inwardly-projecting portion is positioned on the first inwardly-projecting portion in a radial direction of the connector. To hold the locked state, the coupling nut is further positioned on the second inwardly-projecting portion in the radial direction.

When the connector is pulled from the mating connector to release the coupling, the locked state is also released. By this operation, only the coupling nut is moved backwards in the axial direction relative to the movable member so that the first and the second inwardly-projecting portions can be moved easily in the radial direction.

However, the conventional connector has a complex structure to achieve the aforementioned simple operations. For example, the conventional connector needs comprises two spring members, which press the movable member and the coupling nut, respectively and separately, along the axial direction.

In addition, the locked state is obtained by coaxially positioning the free ends of the first and second spring portions and by keeping the coaxial configurations by the use of the coupling nut. This mechanism is also too complex.

SUMMARY OF THE INVENTION

It is an object of the present invention to provide a connector and a mating connector which have more simple structures and can be locked together or be unlocked by simple operations.

According to this invention, there is provided with a connector comprising:

a connector body, which has a first fitting portion to be fitted with a second fitting portion of a mating connector, wherein the first fitting portion projects in a first direction and is formed with at least one engagement depression, which is depressed in a second direction perpendicular to the first direction;

a coupling member, which is movably fitted with the connector body with a predetermined gap (g) kept between the coupling member and the first fitting portion in the second direction, wherein a movable range of the coupling member is between first and second positions in the first direction, the coupling member faces the engagement depression in the second direction when being positioned at the first position, and the coupling member does not face the engagement depression in the second direction when being positioned at the second position; and urging means for urging the coupling member to be positioned at the first position.

According to this invention, there is further provided with the mating connector, which comprises the second fitting portion and a spring portion, wherein: the second fitting portion has a predetermined thickness in the second direction; the spring portion has a thickness not thicker than the predetermined thickness in the second direction; the spring portion has two ends, one of which is connected to the second fitting portion, while the other is a free end; and the free end is provided with an engagement projection, which projects beyond the second fitting portion in the second direction and is elastically supported by the spring portion.

Preferred developments of the invention will be understood hereinafter as the explanation will proceed.

DESCRIPTION OF PREFERRED EMBODIMENTS

With reference to FIGS. 1 to 19, a plug connector 100 and a receptacle connector 200 are shown in accordance with an embodiment of the present invention. The plug connector 100 and the receptacle connected are able to be mated with each other and be locked under the mated condition.

Figure 3:
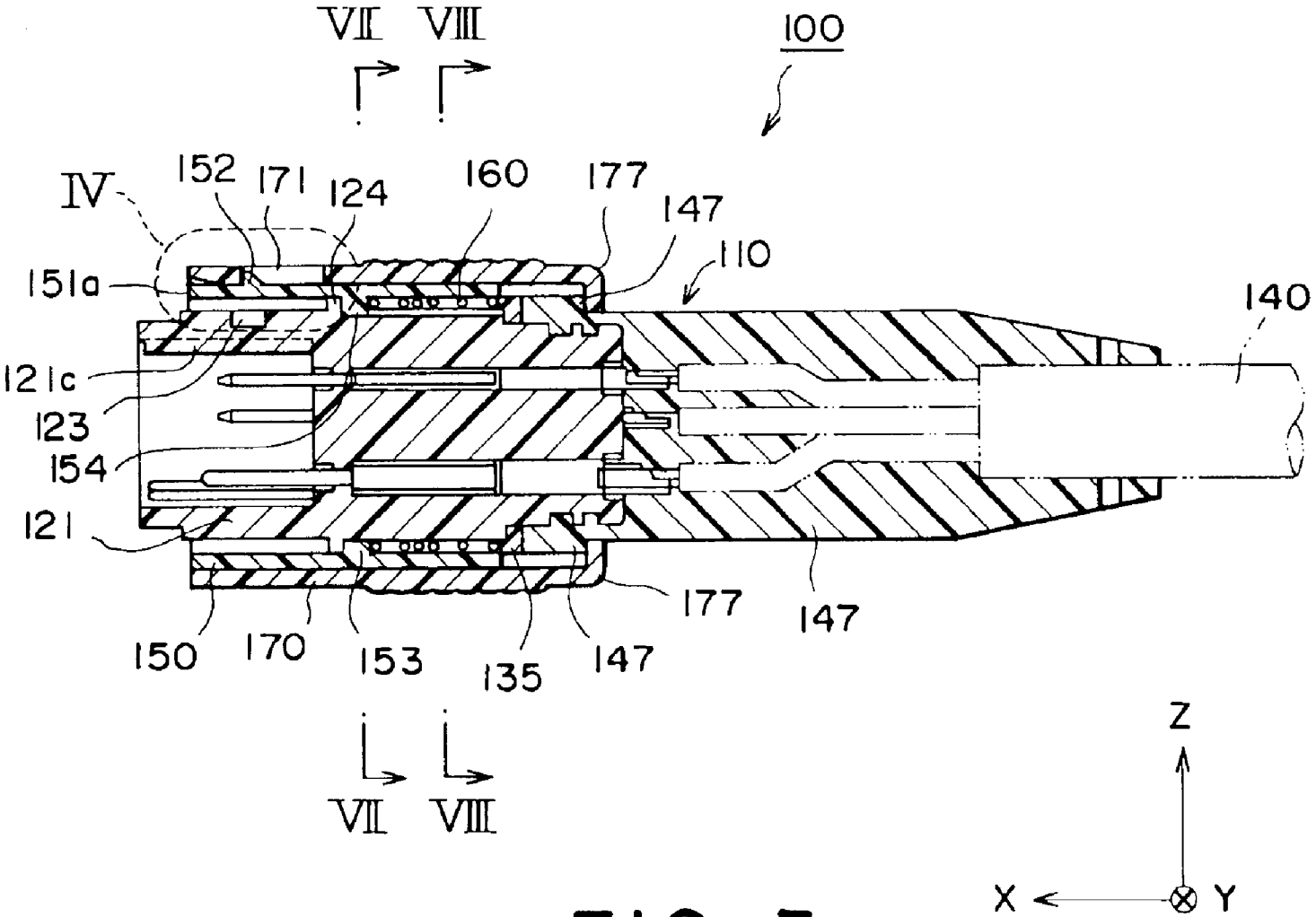
FIG. 3 is a cross-sectional view showing the plug connector of FIG. 2, taken along lines III—III.
Figure 4:
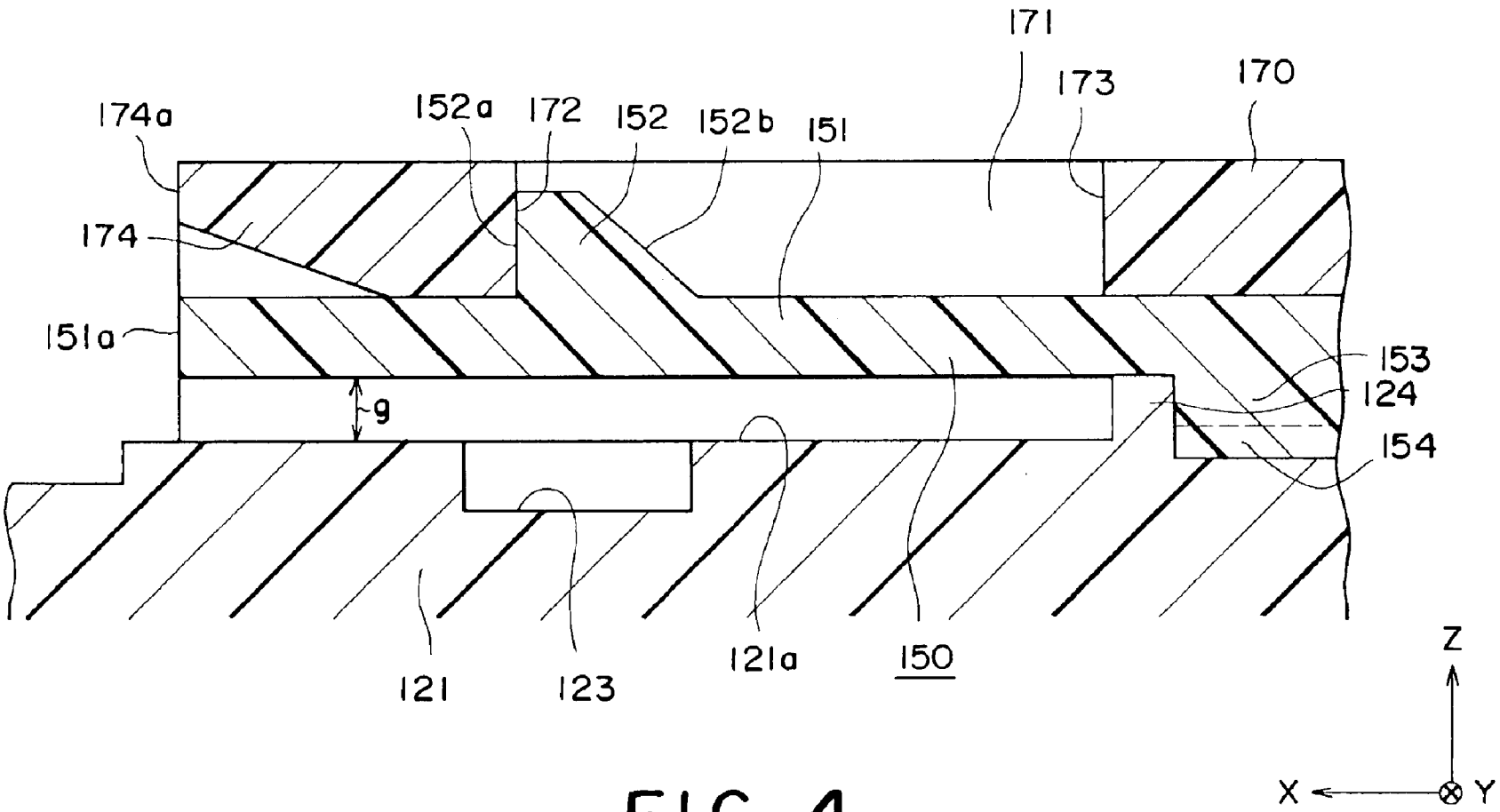
FIG. 4 is an enlarged, cross-sectional view showing a part of the plug connector of FIG. 3, indicated by an enclosure IV.
Figure 5:
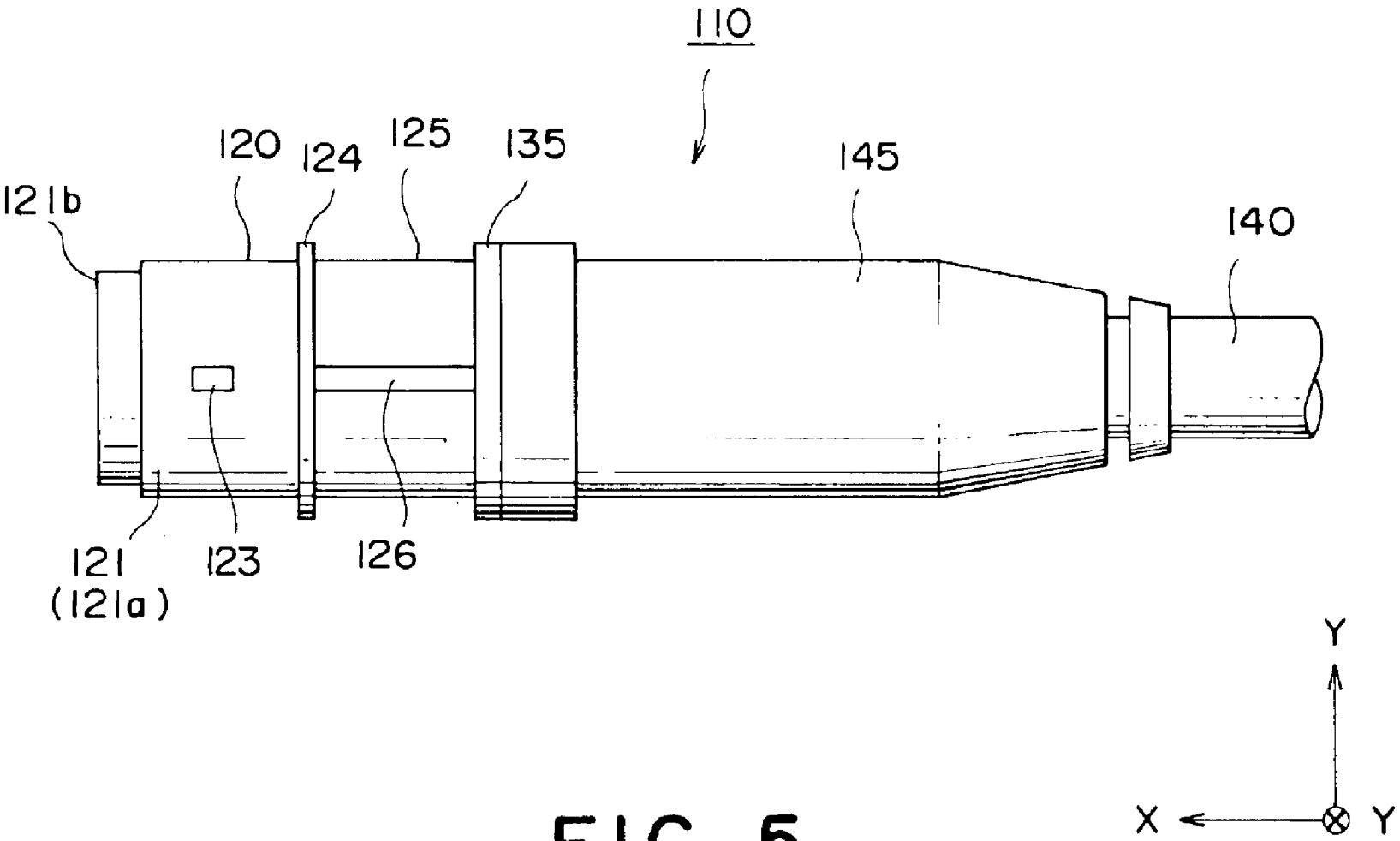
FIG. 5 is a top plan view showing a connector body included in the plug connector of FIG. 1.
Figure 6:
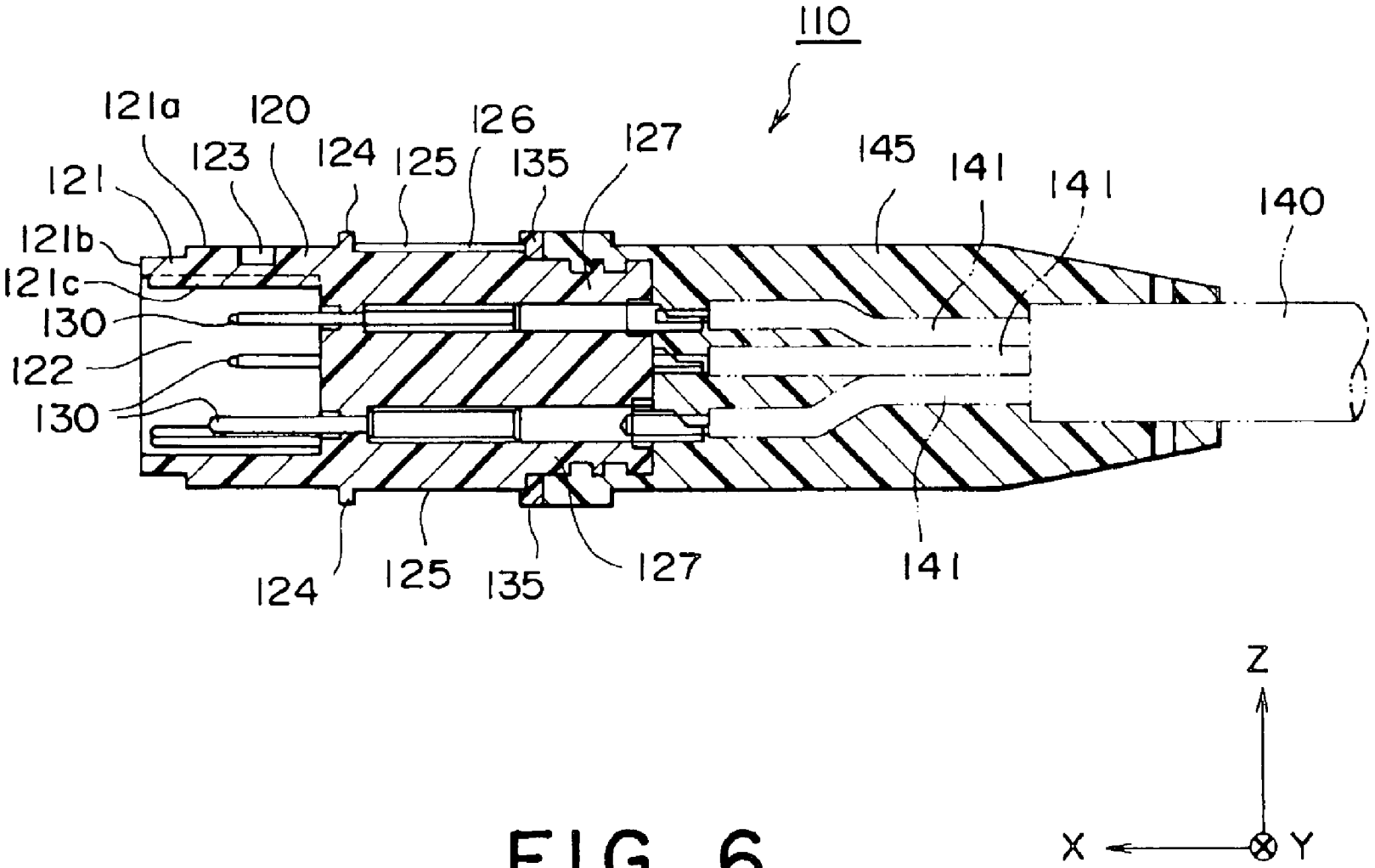
FIG. 6 is a cross-sectional view showing the connector body of FIG. 5, in correspondence with FIG. 3.

As shown in FIGS. 1 to 10, the plug connector 100 comprises a connector body 110 as a main component thereof. The connector body 110 has an insulator 120 and a plurality of contact pins 130. As best shown in FIGS. 5 and 6, the insulator 120 is elongated in an X-direction and has a generally columnar external shape. The insulator 120 is provided with a fitting portion 121 as its end portion in the X-direction. The fitting portion 121 has a generally cylindrical shape, as seen from FIGS. 2 and 6, and defines a receiving hole 122, which serves to receive a part of the receptacle connector 200 as will be described afterwards. The receiving hole 122 has a columnar shape in this embodiment. The contacts pins 130 are held by the insulator 120 so that one ends of the contacts pins 130 project within the receiving hole 122 as shown in FIG. 6. The other ends of the contact pins 130 are connected to lines 141, which are bundled in a cable 140. The connection points of the contact pins 130 and the lines 141 of the cable 140 are covered by a sheath 145. The sheath 145 is engagingly fitted with the end 127 of the insulator 120, as shown in FIG. 6.

The fitting portion 121 of the insulator 120 has an outer peripheral surface 121*a*, in which engagement depressions 123 are formed, as shown in FIGS. 5, 6, 17 and 18. The number of engagement depressions 123 is two in this embodiment, and the two engagement depressions 123 are positioned opposite to each other in a Z-direction. The engagement depressions 123 are depressed in the Z-direction in this embodiment but are not limited thereto. The engagement depressions may be depressed in other directions perpendicular to the X-direction. The engagement depressions 123 are positioned apart from an end surface 121*b* of the fitting portion 121 in the X-direction, as shown in FIGS. 5 and 6.

The fitting portion 121 is provided with guide keys 121*c*, which are formed on the inner surface of the receiving hole 122. Each of the guide keys 121*c* extends in the X-direction, as shown in FIG. 6, and radially projects towards a center axis of the connector body 110, as shown in FIG. 2.

The insulator 120 is formed with an outwardly-projecting ring 124, which is positioned farther from the end surface 121*b* of the fitting portion 121 than the engagement depressions 123 in the X-direction, as shown in FIGS. 5 and 6. The outwardly-projecting ring 124 defines a radially-depressed recess 125 in cooperation with a supplementary ring 135. The outwardly-projecting ring 124 constitutes a front wall portion of the radially-depressed recess 125, while the supplementary ring 135 constitutes a rear wall portion of the radially-depressed recess 125.

Figure 7:
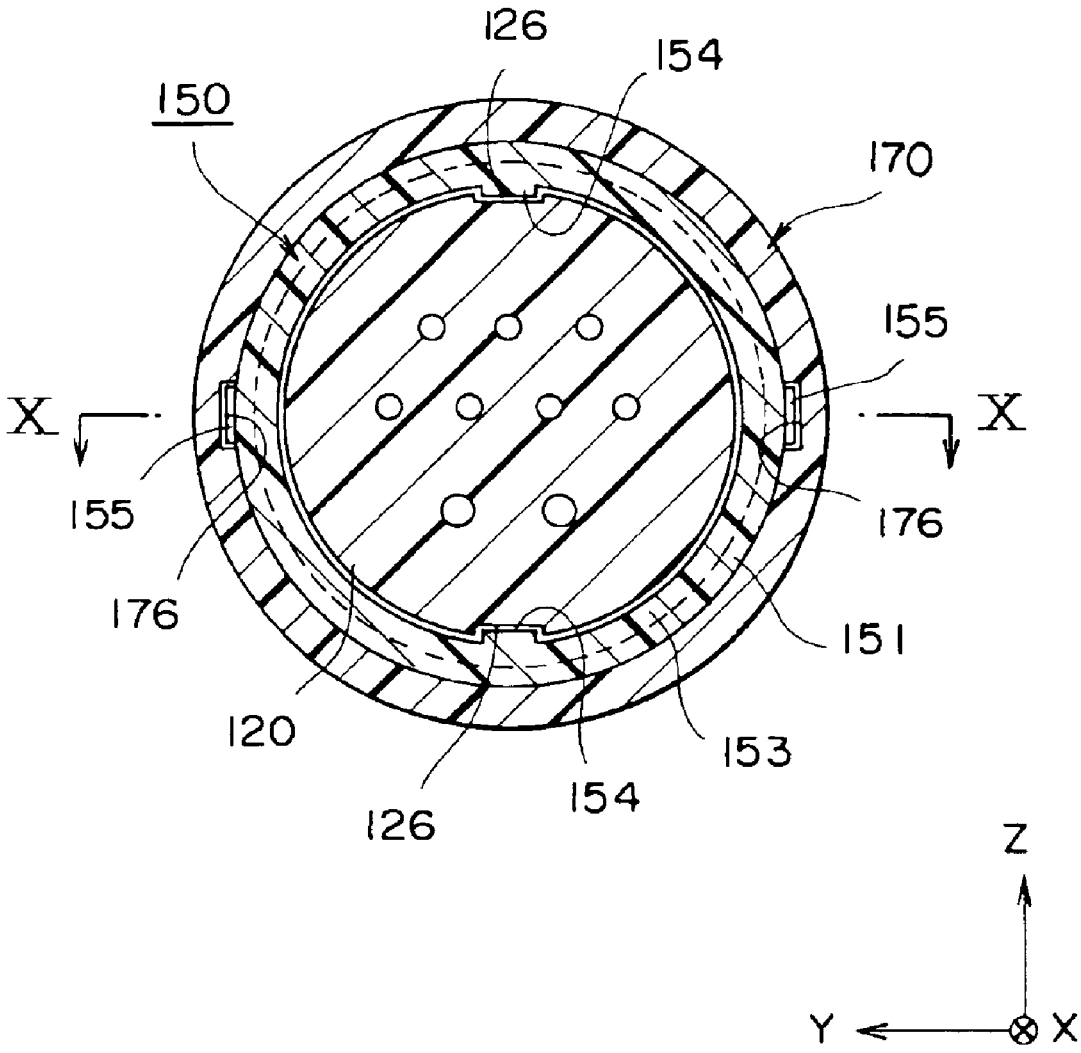
FIG. 7 is a cross-sectional view showing the plug connector of FIG. 3, taken along line VII—VII.
Figure 8:
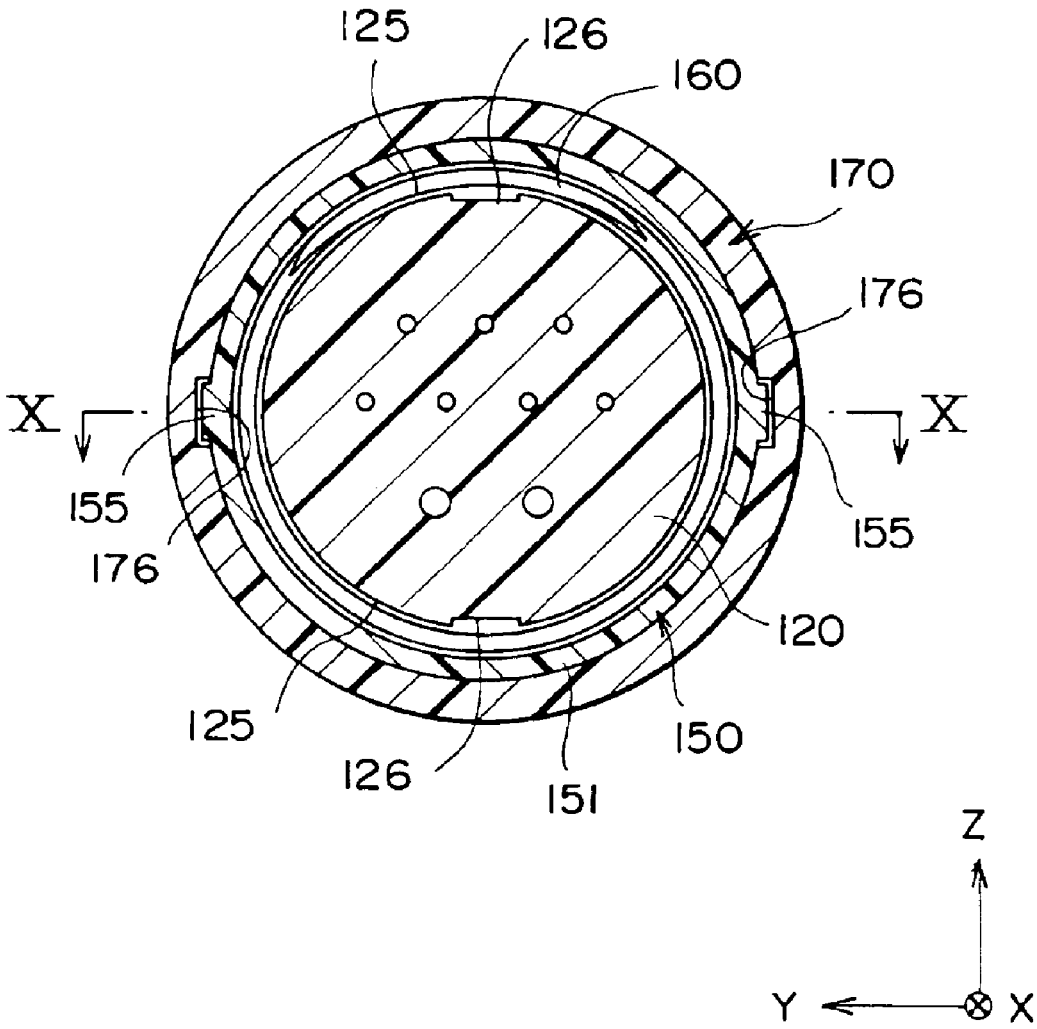
FIG. 8 is a cross-sectional view showing the plug connector of FIG. 3, taken along lines VIII—VIII.
Figure 9:
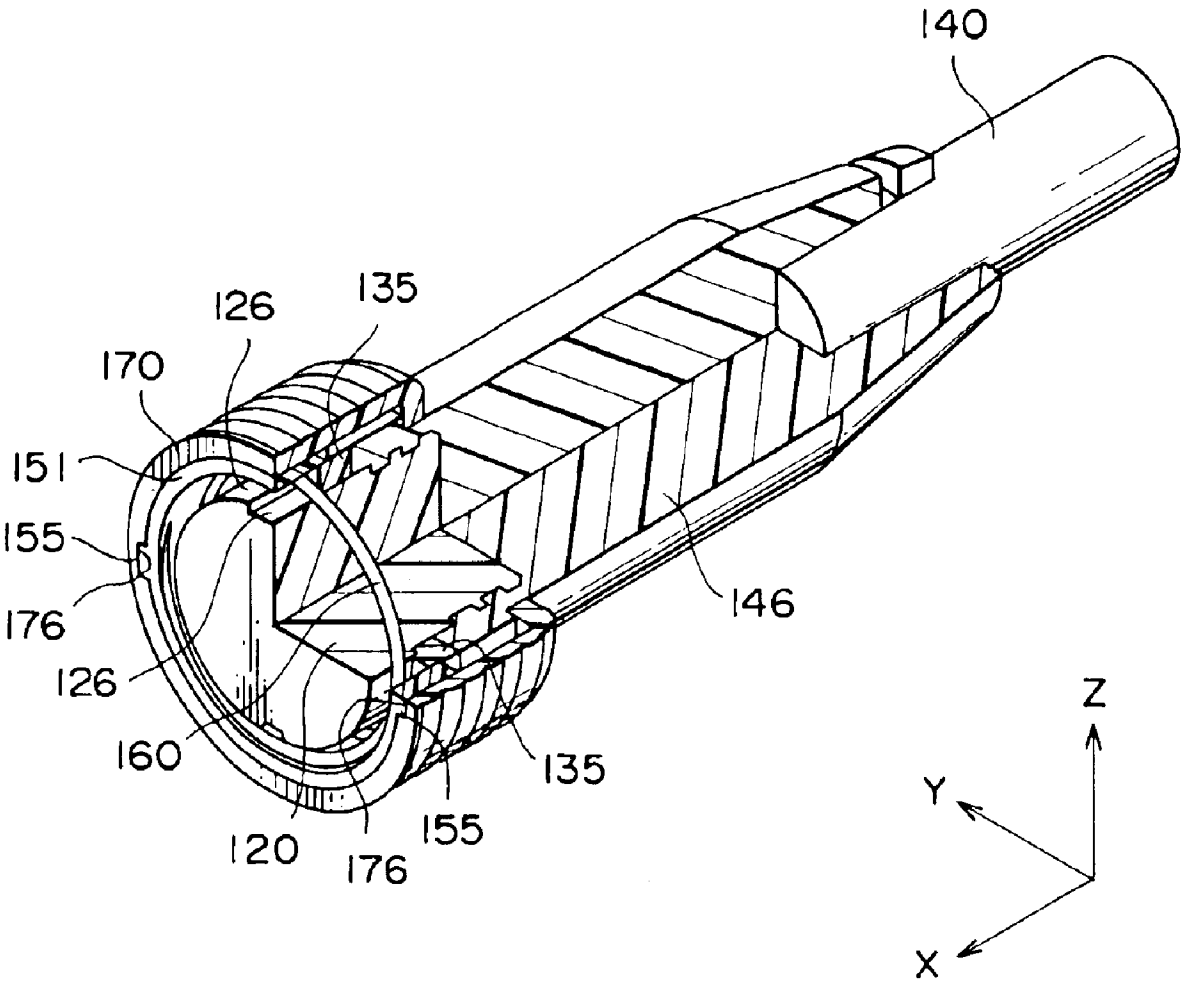
FIG. 9 is a partially-cutaway, perspective view showing the plug connector of FIG. 8.

The radially-depressed recess 125 is formed with sliding guide grooves 126, as shown in FIGS. 5 to 7. As best seen from FIG. 7, the number of the sliding guide grooves 126 is two in this embodiment. As seen from FIGS. 5 and 6, the sliding guide grooves 126 extend in the X-direction. Also, as shown in FIGS. 6 and 7, the sliding guide grooves 126 are depressed in the Z-direction in this embodiment but are not limited thereto. The sliding guide grooves 126 may be depressed in other directions perpendicular to the X-direction.

Figure 1:
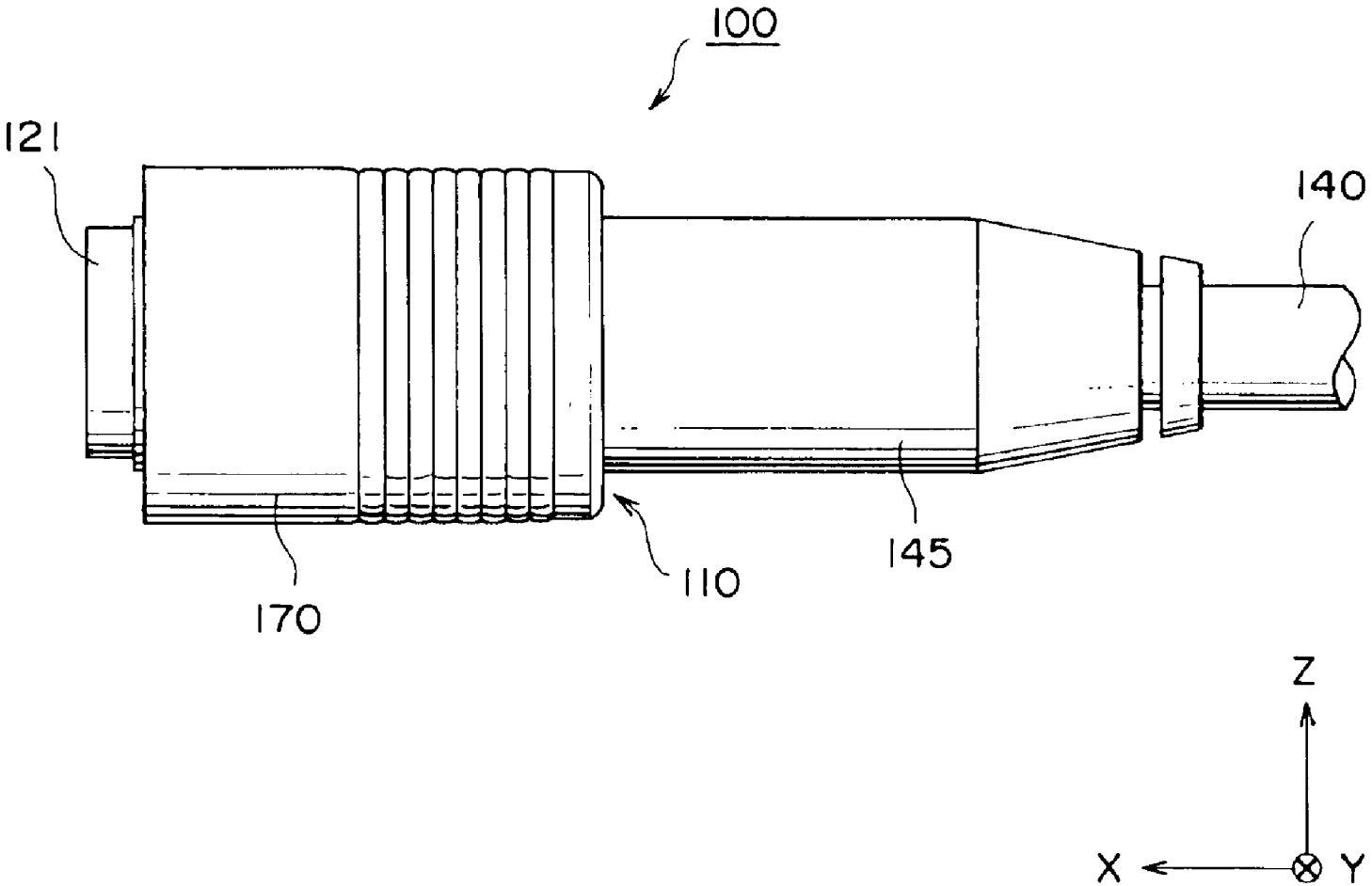
FIG. 1 is a side view showing a plug connector in accordance with an embodiment of the present invention.
Figure 2:
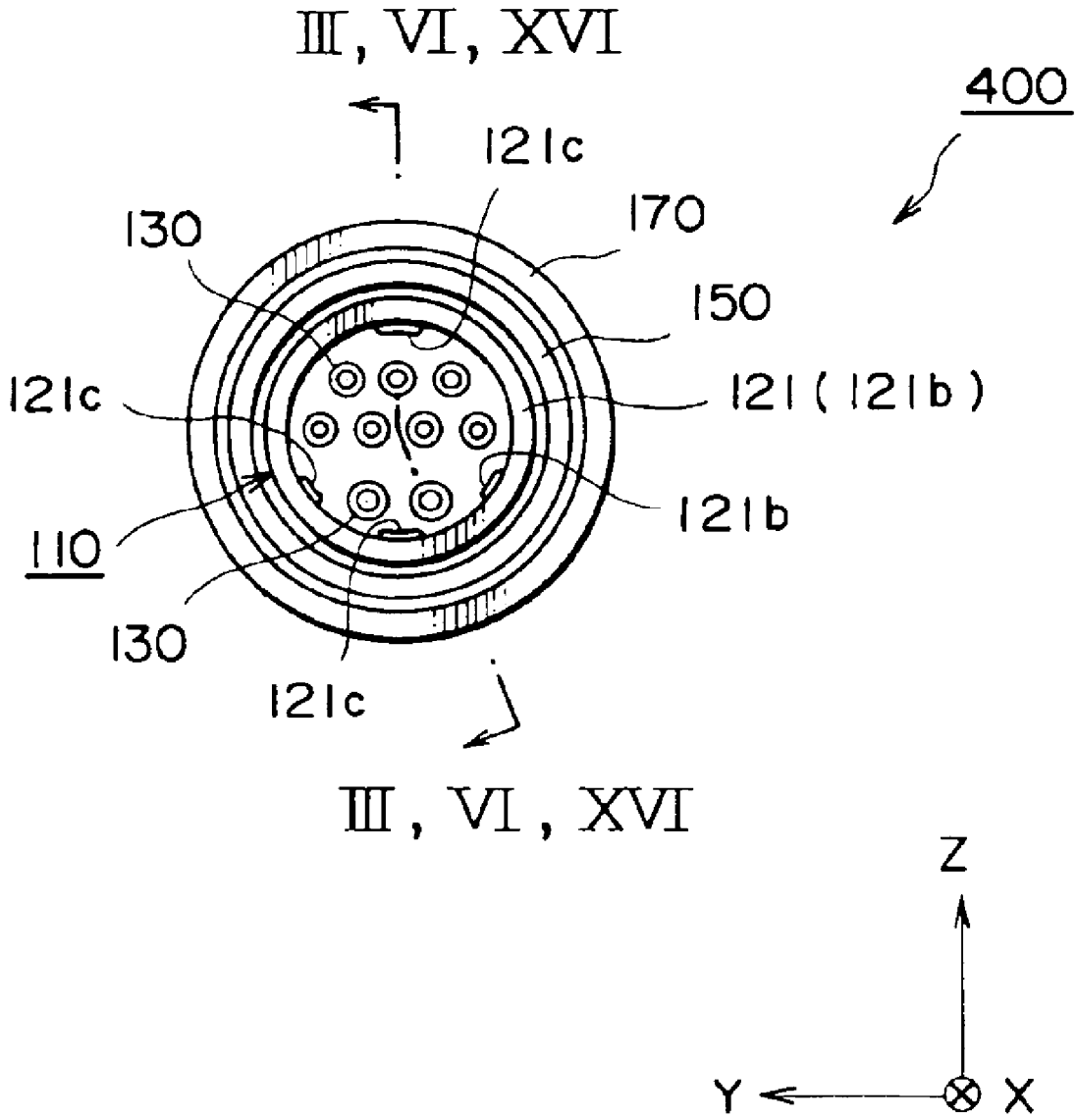
FIG. 2 is a front view showing the plug connector of FIG. 1.

As shown in FIGS. 2 and 3, a coupling member 150 is fitted with the insulator 120. The coupling member 150 has a generally cylindrical portion 151, which surrounds the outer peripheral surface 121*a* of the fitting portion 121.

Figure 17:
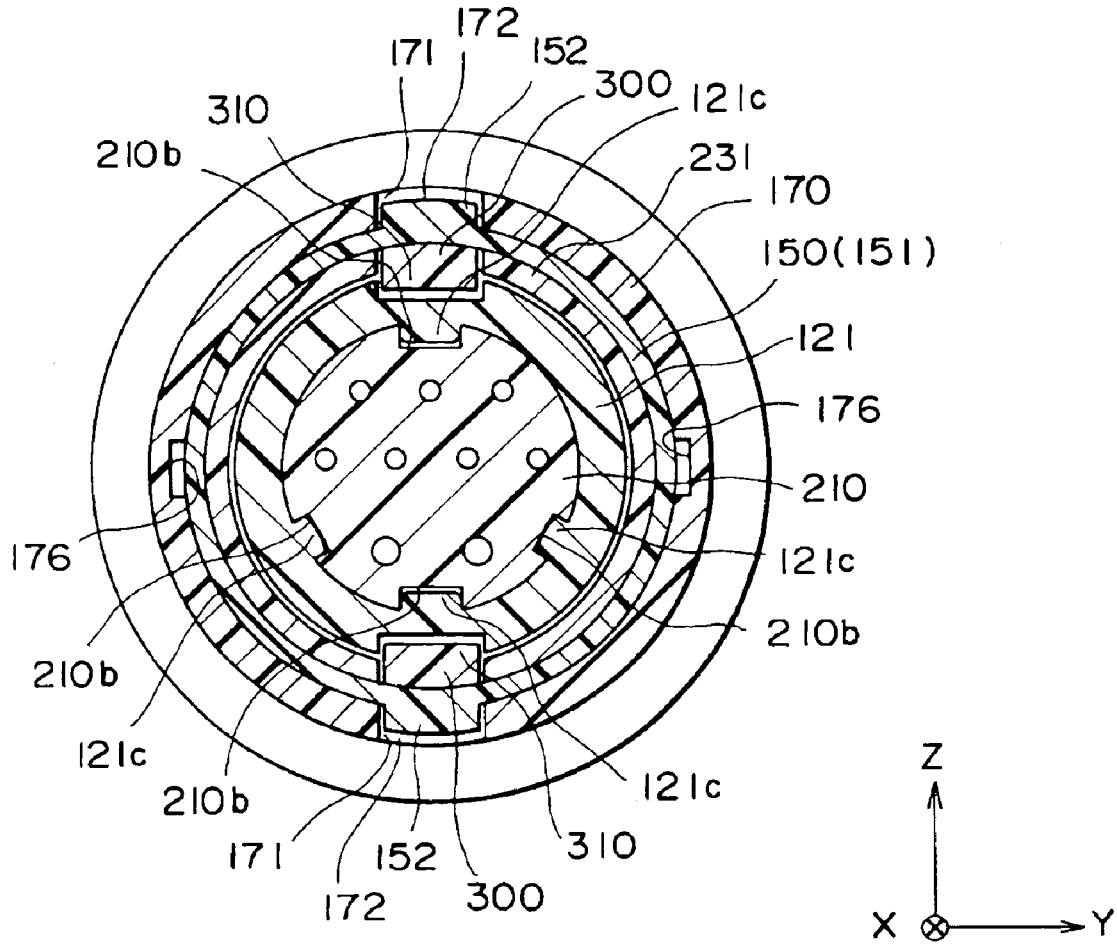
FIG. 17 is a cross-sectional view showing the combination of FIG. 15, taken along lines XVII—XVII.
Figure 18:
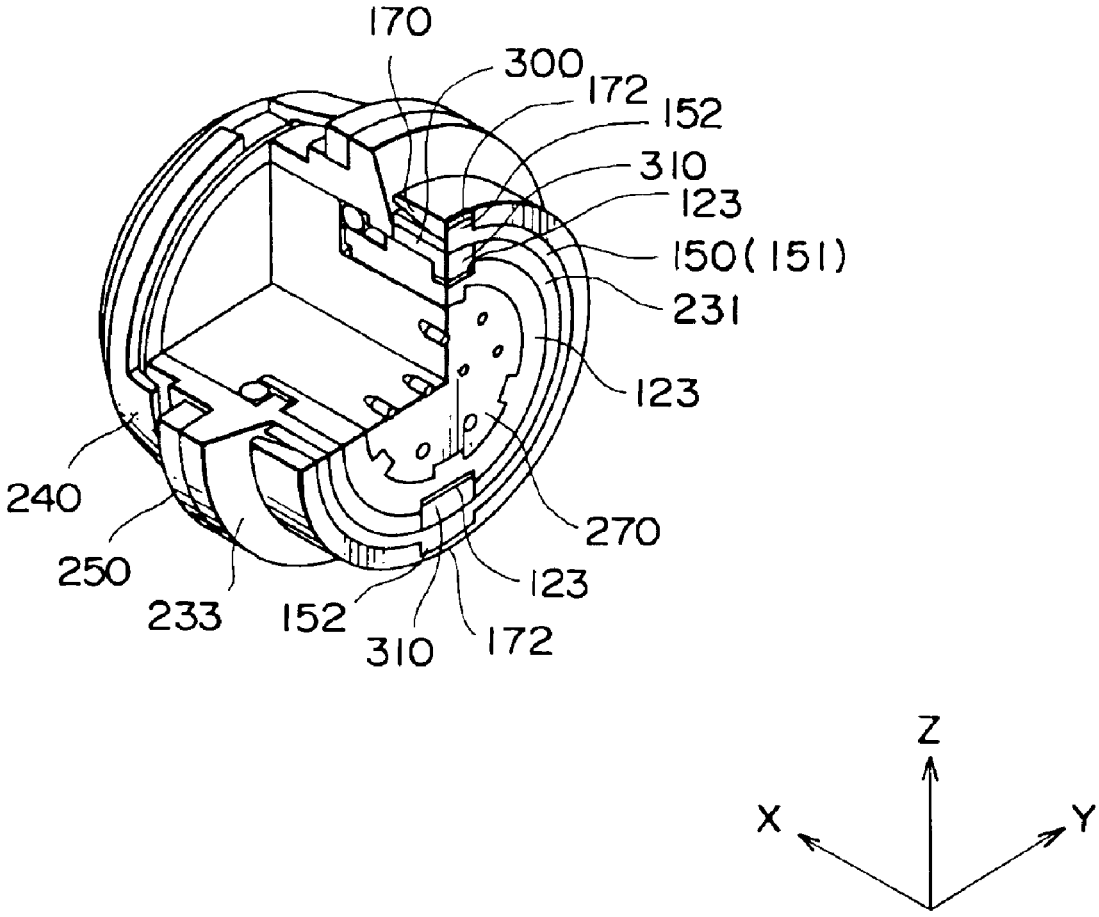
FIG. 18 is a partially-cutaway, perspective view showing the combination of FIG. 15.

The coupling member 150 is provided with outwardly-projecting portions 152, which are positioned apart from an end surface 151*a* of the cylindrical portion 151, as seen from FIG. 4. As shown in FIGS. 17 and 18, the number of the outwardly-projecting portions 152 is two in this embodiment but, of course, is not limited thereto. As seen from FIG. 4, each of the outwardly-projecting portions 152 has a front surface 152*a*, which is a flat surface perpendicular to the X-direction. Each outwardly-projecting portion 152 has a slanting surface 152*b* as a rear surface thereof in the X-direction.

Figure 10:
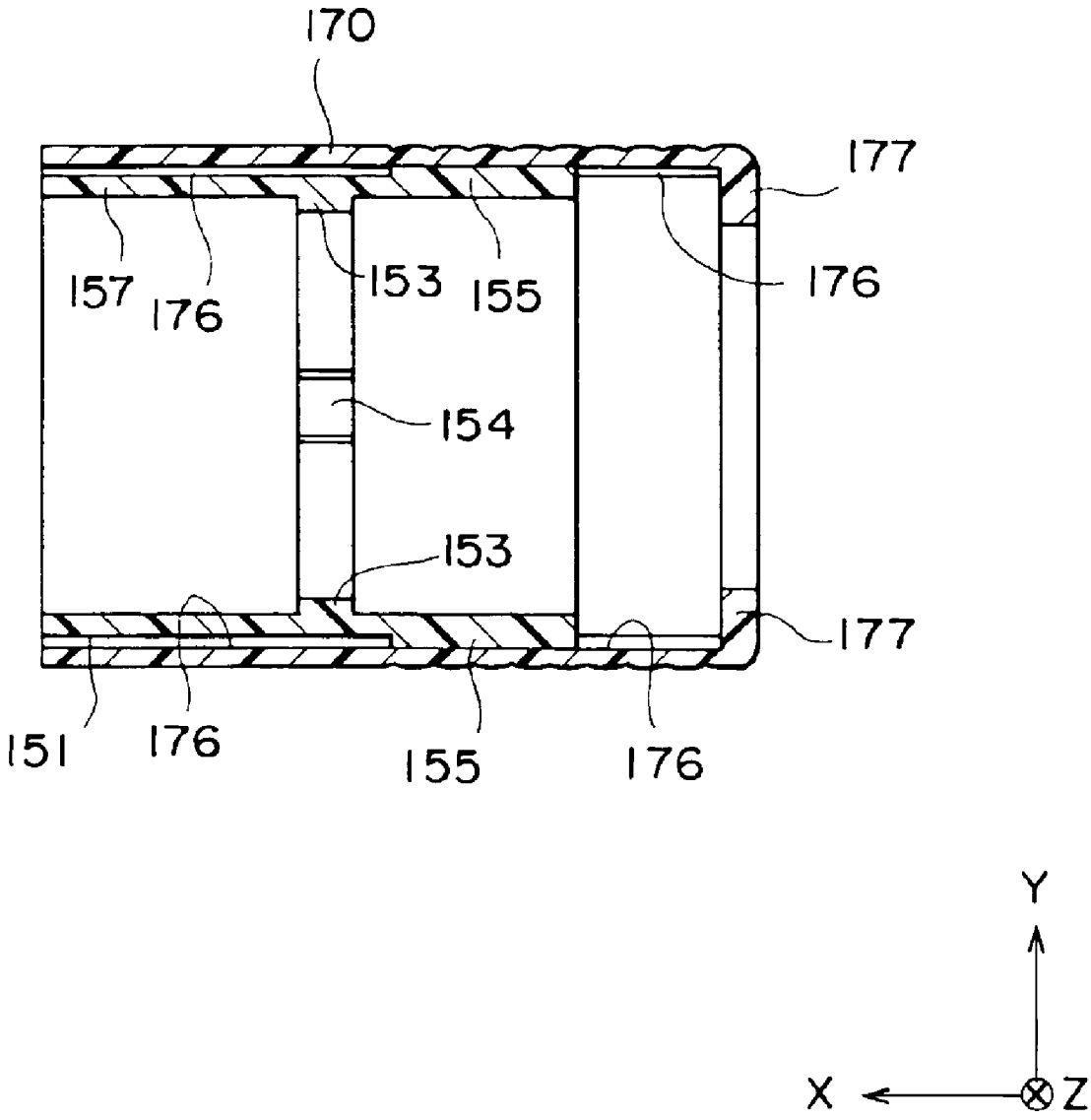
FIG. 10 is a cross-sectional view showing a coupling member and an outer cover of the plug connector of FIG. 1, taken along lines X—X of FIGS. 8 and 9.
Figure 11:
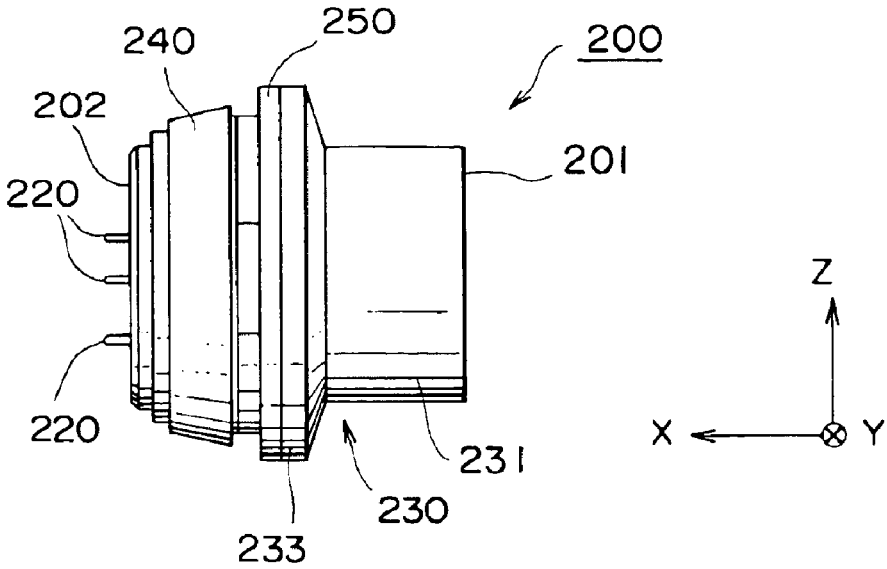
FIG. 11 is a side view showing a receptacle connector which is able to be mated with the plug connector of FIG. 1.
Figure 12:
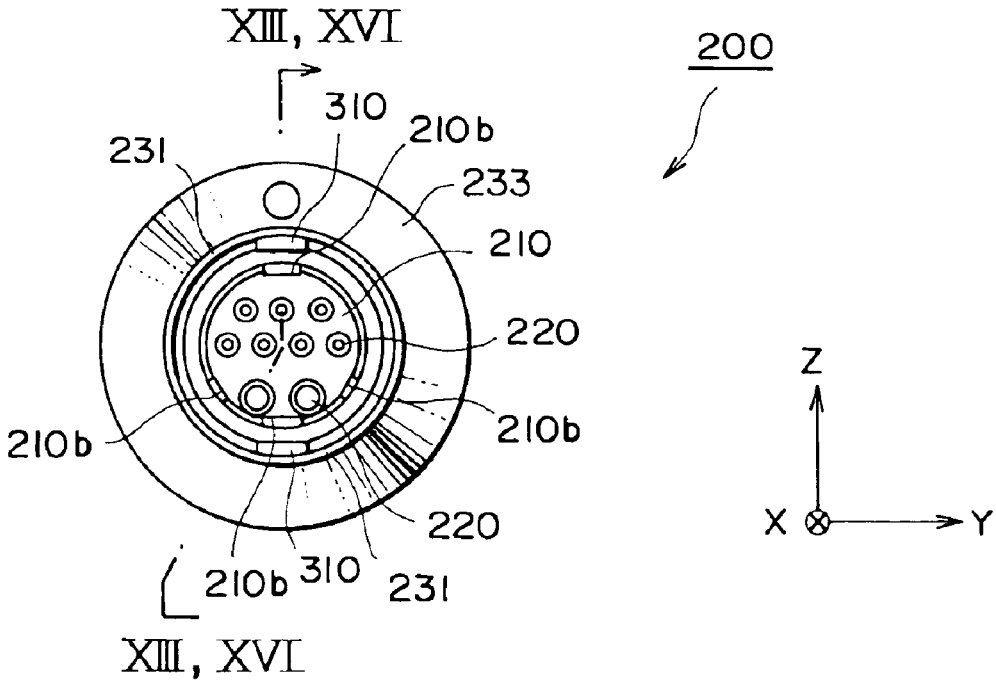
FIG. 12 is a front view showing the receptacle connector of FIG. 11.

Also, the coupling member 150 is formed with an inwardly-projecting ring 153, as shown in FIGS. 3, 4 and 10. In the X-direction, the inwardly-projecting ring 153 is positioned farther away from the end surface 151*a* of the cylindrical portion 151 than the outwardly-projecting portion 152. The inwardly-projecting ring 153 is accommodated within the radially-depressed recess 125, while the outwardly-projecting ring 124 and the supplementary ring 135 support the cylindrical portion 151 in the radial direction of the connector body 110. Therefore, the cylindrical portion 151 is slidable on the periphery of the connector body 110 with a predetermined gap (g) kept between the cylindrical portion 151 and the outer peripheral surface 121*a* of the fitting portion 121, as seen from FIGS. 3 and 4.

In addition, the inwardly-projecting ring 153 is provided with sliding guide projections 154, which further inwardly project from parts of the inwardly-projecting ring 153, as seen from FIGS. 3, 4 and 10. The number of the sliding guide projections 154 is two in this embodiment. The sliding guide projections 154 are movably and slidably fitted within the sliding guide grooves 126.

Under the state where the sliding guide projections 154 are fitted within the sliding guide grooves 126, there is defined an annular space by the radially-depressed recess 125 and the cylindrical portion 151. The annular space accommodates a helical coil spring 160, as shown in FIG. 3. The helical coil spring 160 is positioned between the inwardly-projecting ring 153 and the supplementary ring 135 and presses the inwardly-projecting ring 153 against a side of the outwardly-projecting ring 124 of the insulator 120 in the X direction.

When the inwardly-projecting ring 153 is pressed against the outwardly-projecting ring 124 in the X-direction, the cylindrical portion 151 is positioned over the engagement depressed portion with the predetermined gap (g), as shown in FIG. 4. The position of the coupling member 150 under this state is referred to as a first position in this application. There is another important position of the coupling member 150, which is called a second position. When the coupling member 150 is positioned at the second position, the cylindrical portion 151 is not positioned over the engagement depression 123 in the radial direction. In detail, the coupling member 150 is positioned at the second position, when the coupling member 150 is moved out the X-direction or is pressed back in the X-direction, while opposing the helical coil spring 160. As seen from the above-mentioned explanation, the helical coil spring 160 serves as urging means for urging the coupling member to be positioned at the first position.

The coupling member 150 is also formed with elongated protrusions 155, as shown in FIGS. 3 and 7 to 10. The elongated protrusions 155 are positioned at opposite sides of the coupling member 150 in the Y-direction and are elongated in the X-direction. The elongated protrusions 155 extend from the rear end surface of the cylindrical portion 151 of the coupling member 150 in the X-direction but do not reach the back side of the inwardly-projecting ring 153, as shown in FIG. 10. In this embodiment, the lengths of the elongated protrusions 155 have one third of the X-directional length of the coupling member 150.

The coupling member 150 is surrounded by an outer cover 170, as shown in FIGS. 2 to 4 and 7 to 10. The outer cover 170 has a shape like a cup with an opening formed in its bottom. The outer cover 170 holds the outside of the coupling member 150 so that the outer cover 170, outwardly-projecting ring 124 and the supplementary ring 135 keep the predetermined gap g between the coupling member 150 and the fitting portion 121. The rear end 177 of the outer cover 170, i.e. a bottom corner of the cup, is received by a shoulder portion 147 of the sheath 145.

The outer cover 170 is formed with slits 171, as shown in FIGS. 3, 4, 17 and 18. Each of the slits 171 extends in the X-direction and has front and rear wall portions 172, 173, as shown in FIG. 4. The outwardly-projecting portion 152 of the coupling member 150 is accommodated within the associated slit 171 and is movable between the front and rear wall portion 172, 173. When the coupling member 150 is positioned at the first position, the front surface 152*a* of the outwardly-projecting portion 152 is brought into contact with the front wall portion 172 of the slit 171. When the outer cover 170 is pulled back along the X-direction, the contact between the front surface 152*a* of the outwardly-projecting portion 152 and the front wall portion 172 of the slit 171 is kept so that the coupling member 150 is also pulled back along the X-direction. When only the coupling member 150 is pressed back along the X-direction, the front surface 152*a* of the outwardly-projecting portion 152 is moved away from the front wall portion 172 of the slit 171 so that the outer cover 170 remains with the rear end 177 received by the shoulder portion 147 of the sheath 145.

An end portion 174 of the outer cover 170 has a thickness decreased towards an end surface 174*a* thereof in the X-direction, as best shown in FIG. 4. The end portion 174 provides two effects, one of which is fabrication ease of the coupling member 150 and the outer cover 170. When the outer cover 170 is fitted on the coupling member 150, the outer cover 170 is slid on the coupling member 150 forwards in the X-direction relative to the coupling member 150. During this fabrication process, the end portion 174 rides on the slanting surfaces 152*b* of the outwardly-projecting portions 152 so that the end portions 174 can smoothly ride over the outwardly-projecting portions 152, and the outer cover 170 is fitted on the coupling member 150. The other effect of the end portion 174 is that it is easy to press only the coupling member 150 back along the X-direction.

The outer cover 170 is formed with elongated recesses 176, as shown in FIGS. 7 to 10, 17 and 18. The elongated recesses 176 are formed in the inner surface of the outer cover 170 and are positioned at the opposite sides in the Y-direction. The elongated recesses 176 extend in the X-direction and receive the respective elongated protrusions 155 of the coupling member 150. In the X-direction, the lengths of the elongated recesses 176 are three times longer than the lengths of the elongated protrusions 155 so that the contact area between the outer cover 170 and the coupling member 150 is reduced, and a smooth sliding of the coupling member 150 independent of the outer cover 170 is ensured.

Figure 13:
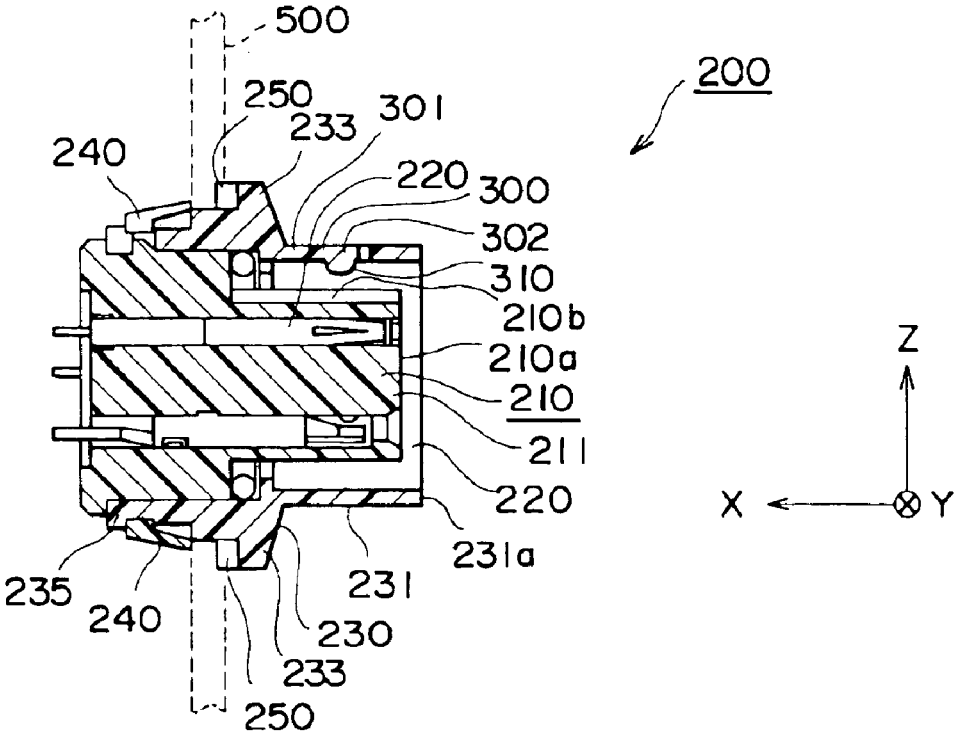
FIG. 13 is a cross-sectional view showing the receptacle connector of FIG. 12, taken along lines XIII—XIII.
Figure 14:
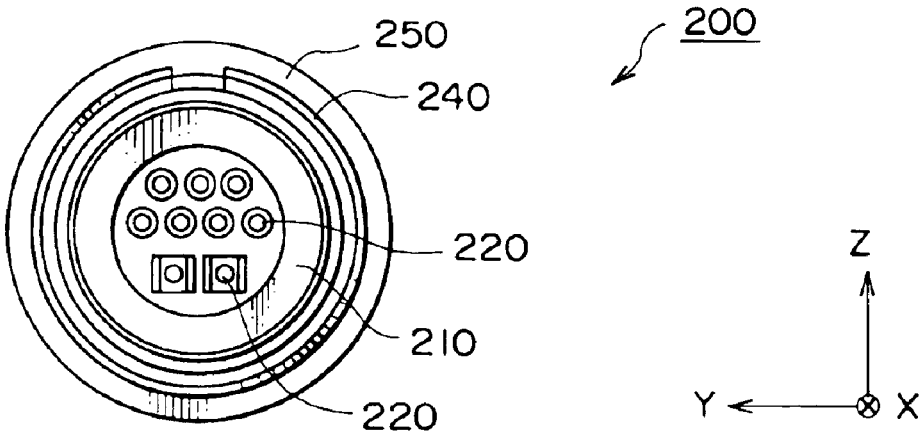
FIG. 14 is a rear view showing the receptacle connector of FIG. 11.
Figure 15:
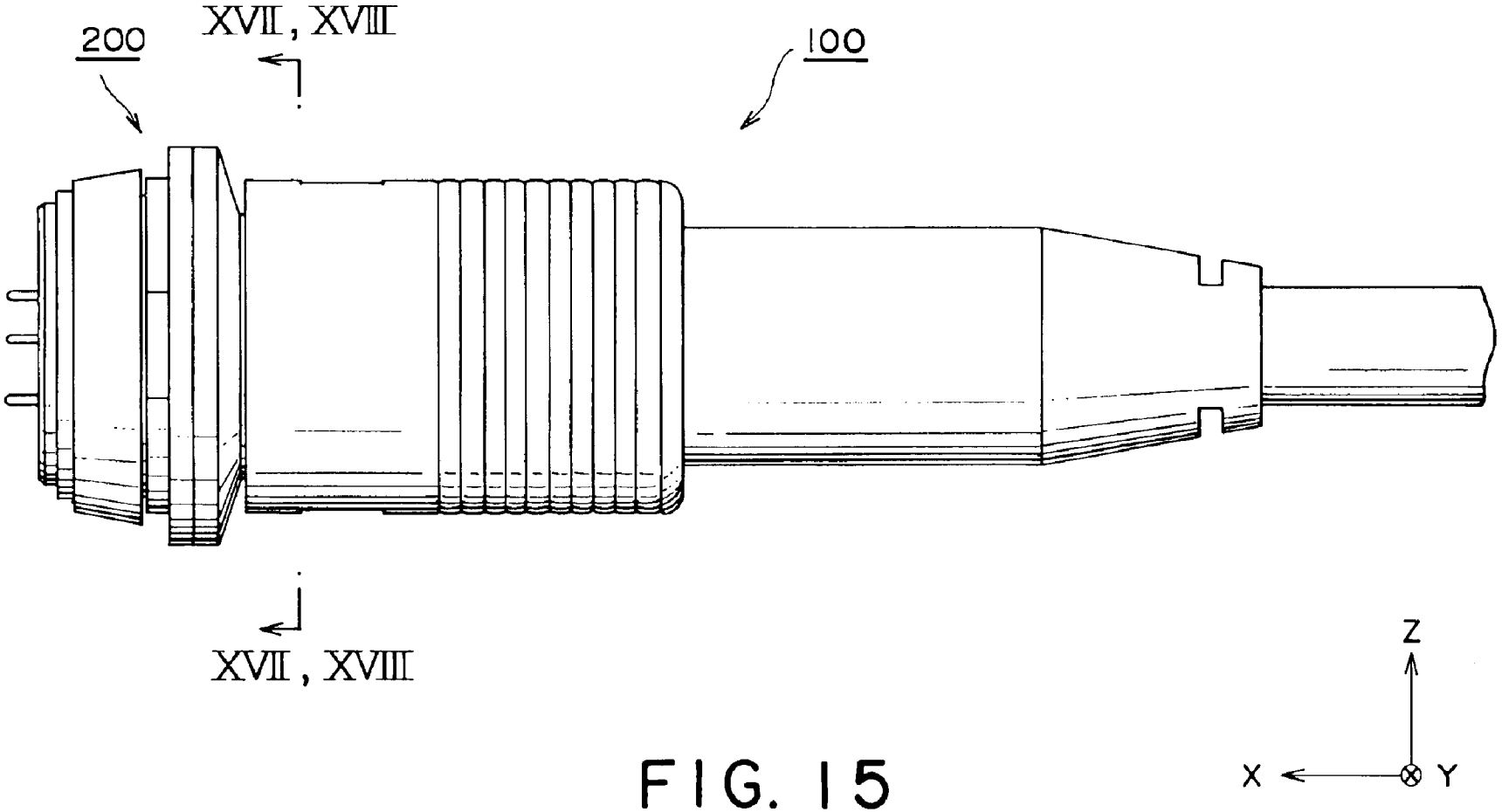
FIG. 15 is a side view showing a combination of the plug connector of FIG. 1 and the receptacle connector of FIG. 11, which are under a locked state.

With reference to FIGS. 11 to 14, the receptacle connector 200 comprises an insulator 210, a plurality of contact pins 220 and an outer member 230. The insulator 210 has a columnar projection portion 211, which is sized to be smoothly and fitly received by the receiving hole 122 of the plug connector 100. The insulator 210 has a plurality of holes which continue to an end 210*a* of the columnar projection portion 211 and hold the respective contact pins 220 therein, as shown in FIG. 13.

On the outer periphery of the columnar projection portion 211, there are formed guide grooves 210*b*. The guide grooves 210*b* are positioned and sized to suitably receive the respective guide keys 121*c* of the fitting portion 121 of the plug connector 100.

The outer member 230 surrounds the outer periphery of the insulator 210. The outer member 230 is comprised of a fitting portion 231, a flange portion 233 and a cylindrical rear portion 235, as shown in FIG. 13. The fitting portion 231 has a cylindrical shape and has a size which is suitably and fitly received in the predetermined gap g of the plug connector 100. In detail, the thickness of the fitting portion 231 of the receptacle connector is substantially equal to the predetermined gap g of the plug connector 100.

The cylindrical rear portion 235 is provided with securing means such as clips 240. The clips 240 are used for securing the receptacle connector 200 to a board or a panel 500. In detail, a gasket 250 is provided at a side of the flange portion 233 of the outer member 230, and the gasket 250 and the clips 240 catch the panel 500 therebetween, as imaginarily shown in FIG. 13.

The fitting portion 231 is provided with spring portions 300, which correspond to the respective engagement depressions 123 of the plug connector 100. In this embodiment, the spring portions 300 have the same thickness as the fitting portion 231 but are not limited thereto. The spring portions 300 may have another thickness smaller than the predetermined gap g.

Each of the spring portions 300 has two ends 301, 302. One end 301 of the spring portion 300 is connected by the fitting portion 231. The other end 302 is a free end, which is provided with an engagement projection 310. The engagement projection 310 inwardly projects in the radial direction of the receptacle connector 200. In other words, the engagement projection 310 is elastically supported by the fitting portion 231.

An end 231*a* of the fitting portion 231 projects beyond the end 210*a* of the insulator 210 in the X-direction. The end 210*a* of the insulator 210 projects beyond the engagement projections 310 in the X-direction so that the end 231*a* of the fitting portion 231 projects beyond the engagement projections 310 in the X-direction, as shown in FIG. 13.

Next explanation will be made about the mating operations of the plug and the receptacle connector 100, 200.

Figure 16:
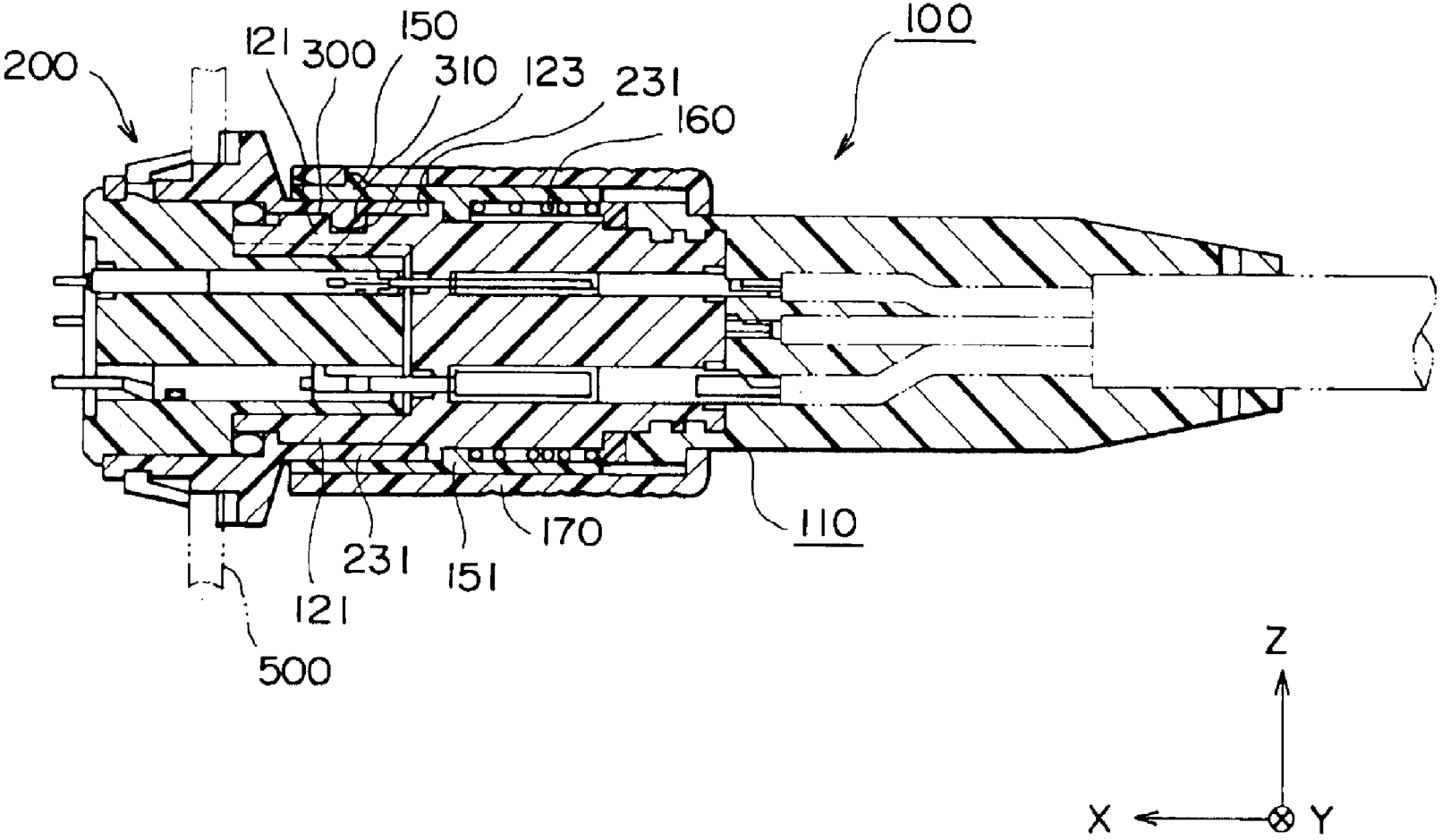
FIG. 16 is a cross-sectional view showing the combination of FIG. 15, taken along lines XVI—XVI of FIGS. 2 and 12.
Figure 19:
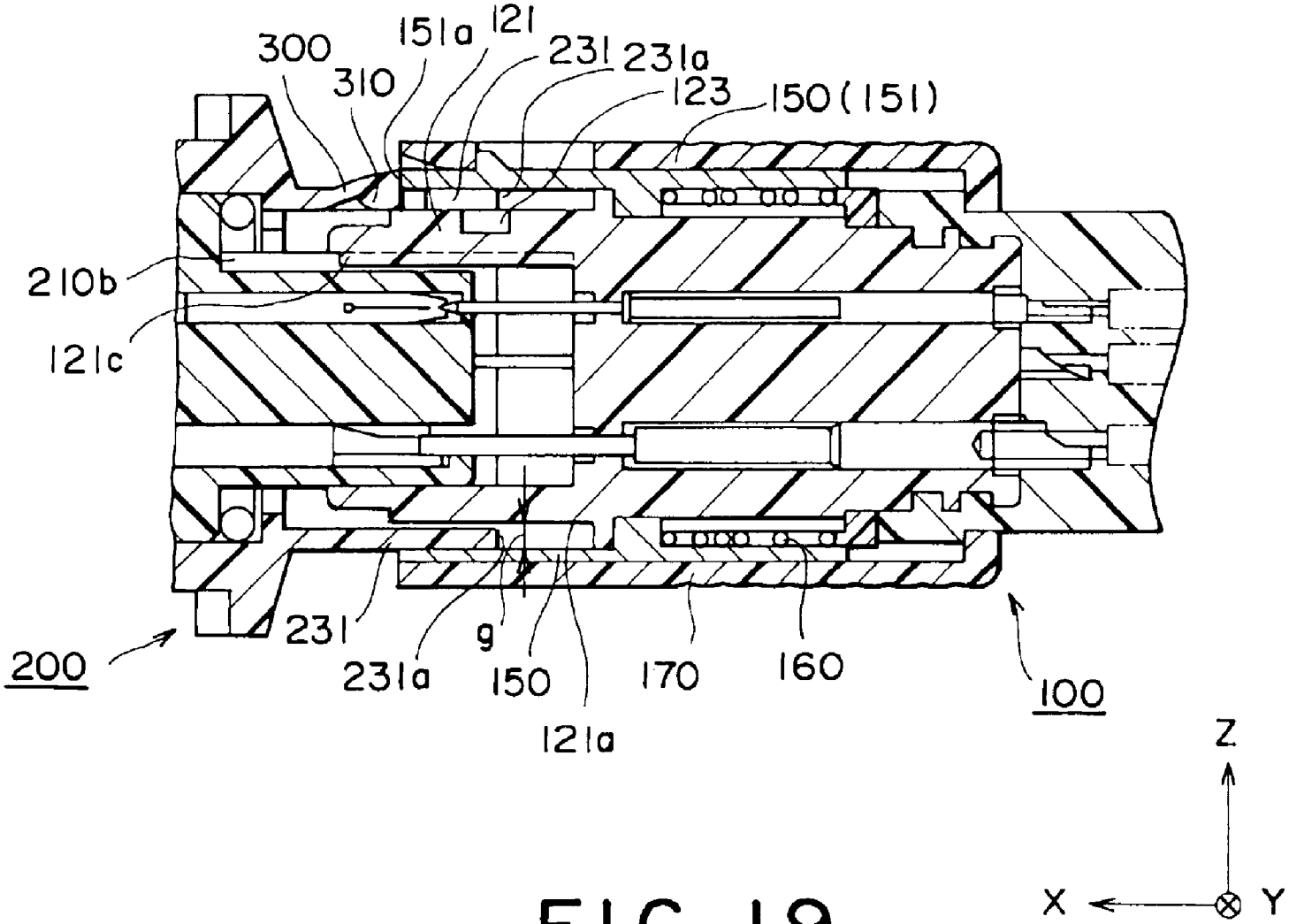
FIG. 19 is a cross-sectional view showing the combination of FIG. 15, wherein the plug connector starts to be connected to the receptacle connector but is not locked to the receptacle connector.

As shown in FIG. 19, the end 231*a* of the fitting portion 231 of the receptacle connector 200 is first inserted into the predetermined gap g of the plug connector 100. Then, the guide grooves 210*b* receive the respective guide keys 121*c*. As the insertion continues the engagement projections 310 ride on the outer peripheral surface 121*a* of the fitting portion 121 of the plug connector 100. Then, the engagement projections 310 press only the end surface 151*a* of the coupling member 150 in the X-direction so that the coupling member 150 is moved backwards relative to the outer cover 170. As the insertion further continues, the engagement projections 310 arrive at the respective engagement depressions 123 so that the engagement projections 310 are received by the respective engagement depressions 123, as shown in FIG. 16. Because the thickness of the fitting portion 231 of the receptacle connector 200 is substantially equal to the predetermined gap g of the plug connector 100, the coupling member 150 can be moved forwards in the X-direction after the engagement projections 310 are received in the respective engagement depressions 123. The coupling member 150 is pressed forwards by the helical coil spring 160 and locks the engagement of the engagement projections 310 and the engagement depression 123, as shown in FIGS. 16 to 18. Note that the above-mentioned mating and locking operations are quite easily carried out only by pressing the plug connector 100 against the receptacle connector 200.

Unlocking and disconnecting operations are also simple and are carried only by pulling the outer cover 170 backwardly in the X-direction. The pulling back of the outer cover 170 forces the coupling member 150 to be slid and moved to the second position of the coupling member 150 so that the engagement projections 310 become able to freely move in the radial direction of the receptacle connector 200. As the pulling back operation continues, the engagement projections 310 ride on the outer peripheral surface 121*a* of the fitting portion 121 of the plug connector 100 so that the engagement projections 310 are disengaged from the engagement depressions 123, and the plug connector 100 can be removed from the receptacle connector 200.

What is claimed is:

1. A connector comprising:

a connector body, which has a first fitting portion to be fitted with a second fitting portion of a mating connector, wherein the first fitting portion projects in a first direction and is formed with at least one engagement depression, which is depressed in a second direction perpendicular to the first direction;

a coupling member, which is movably fitted with the connector body with a predetermined gap kept between the coupling member and the first fitting portion in the second direction, wherein a movable range of the coupling member is between first and second positions in the first direction, the coupling member faces the engagement depression in the second direction when being positioned at the first position, and the coupling member does not face the engagement depression in the second direction when being positioned at the second position; and urging means for urging the coupling member to be positioned at the first position, wherein the first fitting portion has an outer peripheral surface, in which the engagement depression is formed; and the coupling member has a tubular portion, which surrounds the outer peripheral surface of the first fitting portion with the predetermined gap kept between the tubular portion and the outer peripheral surface of the first fitting portion in the second direction, the connector further comprising an outer cover, which covers and supports the coupling member to keep the predetermined gap, wherein the outer cover is movably fitted with the connector body; the outer cover has a slit, which is elongated in the first direction and has a front wall portion; the coupling member is formed with an outwardly-projecting portion, which is movably positioned within the slit of the outer cover and has a front surface; such that when the coupling member is positioned at the first position, the front surface of the outwardly-projecting portion is brought into contact with the front wall portion of the slit of the outer cover; such that when only the coupling member is provided with a backward force which moves the coupling member out along the first direction, the front surface of the outwardly-projecting portion is moved away from the front wall portion of the slit of the outer cover; and such that when the outer cover is moved out along the first direction, the front wall portion of the slit of the outer cover presses the front surface of the outwardly-projecting portion backwardly in the first direction, so that the coupling member is moved to or towards the second position, and wherein the urging means is between the connector body and the outer cover and is separated from the slit by the coupling member over the coupling member's movable range.

2. The connector according to claim 1, wherein the outer cover has an end portion whose thickness is decreased towards the first direction.

3. The connector according to claim 1, wherein the outwardly-projecting portion has a slanting surface.

4. The connector according to claim 1, wherein: the connector body has a generally columnar external form, which is provided with a radially-depressed recess; the radially-depressed recess has front and rear wall portions in the first direction; the coupling member is a generally cylindrical shape, which is provided with an inwardly-projecting ring; the inwardly-projecting ring is accommodated within the radially-depressed recess; the urging means comprises a helical coil spring, which is positioned between the inwardly-projecting ring and the rear wall portion of the radially-depressed recess; and the coupling member is positioned at the first position when the inwardly-projecting ring is pressed forward in the first direction by the helical coil spring while stopped by the front wall portion of the radially-depressed recess.

5. The connector according to claim 1, wherein: the connector body comprises an insulator and a plurality of contact pins; the contact pins are held by the insulator and extends in the first direction; and the first fitting portion is formed as one part of the insulator.

6. The connector according to claim 1, wherein the coupling member extends between the urging means and the outer cover to cover the urging means.

7. A mating connector, which is to be mated with the connector according to claim 1 and comprises the second fitting portion and a spring portion, wherein: the second fitting portion has a predetermined thickness in the second direction; the spring portion has a thickness not thicker than the predetermined thickness in the second direction; the spring portion has two ends, one of which is connected to the second fitting portion, while the other is a free end; and the free end is provided with an engagement projection, which projects beyond the second fitting portion in the second direction and is elastically supported by the spring portion.

8. The mating connector according to claim 7, wherein: the second fitting portion has an end which projects beyond the free end of the spring portion along the first direction; and, upon an insertion of the second fitting portion into the predetermined gap between the first fitting portion and the coupling member, the end of the second fitting portion enters the predetermined gap prior to the free end of the spring portion.

9. The mating connector according to claim 7, further comprising a flange portion, a gasket, and securing means, wherein: the flange portion is formed integral with the second fitting portion; the gasket is fitted on a side of the flange portion; and the securing means is for catching a panel in cooperation with the gasket to secure the mating connector to the panel.

10. A combination of the connector according to claim 1 and a mating connector, wherein the mating connector comprises the second fitting portion and a spring portion, wherein the second fitting portion has a predetermined thickness in the second direction, the predetermined thickness being substantially equal to the predetermined gap, and the spring portion has a thickness not thicker than the predetermined thickness in the second direction; the spring portion has two ends, one of which is connected to the second fitting portion, while the other is a free end; and the free end is provided with an engagement projection, which projects beyond the second fitting portion in the second direction and is elastically supported by the spring portion.

* * * * *